United States Patent [19]

Pecoraro

[11] 4,189,884

[45] Feb. 26, 1980

[54] COMPLEX STRUCTURE OBTAINED FROM THE UTILIZATION OF PARTICULAR CLAMPS

[76] Inventor: Irmo Pecoraro, Via Palazzi, 2, Milano, Italy

[21] Appl. No.: 846,559

[22] Filed: Oct. 28, 1977

[51] Int. Cl.[2] ..... E04B 2/72

[52] U.S. Cl. ..... 52/285; 24/81 CC; 52/584

[58] Field of Search ..... 52/282, 285, 284, 584; 24/81 CC, 263 B

[56] References Cited

U.S. PATENT DOCUMENTS

| | | | |
|---|---|---|---|
| 2,300,746 | 11/1942 | Phillips | 52/584 |
| 2,302,920 | 11/1942 | Sobie | 52/584 |
| 2,453,221 | 11/1948 | Haden | 52/584 |
| 2,924,638 | 2/1960 | Feketics | 52/584 |
| 3,430,997 | 3/1969 | Propst | 52/584 |
| 3,861,112 | 1/1975 | Caroselli | 52/285 |

FOREIGN PATENT DOCUMENTS

| | | | |
|---|---|---|---|
| 1933378 | 7/1973 | Fed. Rep. of Germany | 52/285 |
| 2349845 | 4/1975 | Fed. Rep. of Germany | 52/584 |
| 1385274 | 11/1964 | France | 52/285 |
| 477844 | 10/1969 | Switzerland | 52/285 |

*Primary Examiner*—James A. Leppink
*Assistant Examiner*—Henry E. Raduazo
*Attorney, Agent, or Firm*—Bucknam and Archer

[57] ABSTRACT

A clamp is described for connecting at least two panels by means of a connecting element, constituted by at least one pair of identical structures which when coupled delimit longitudinal slits and define a cylindrical seat having chamferred ends, the panels engaging with the slits, the connecting element being inserted into the end portions of the cylindrical seat. The clamp may be used for connecting two orthogonal panels or two coplanar panels of two equal structures. The clamp may also be used as a three-way or four-way clamp.

4 Claims, 22 Drawing Figures

FIG. 13
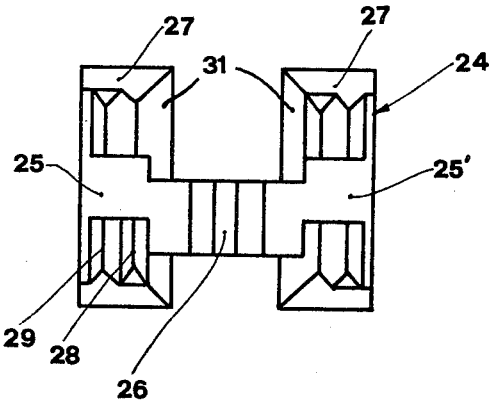
FIG. 14
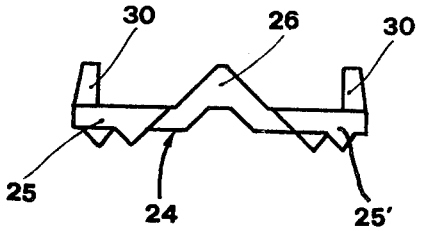
FIG. 15
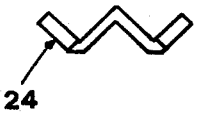
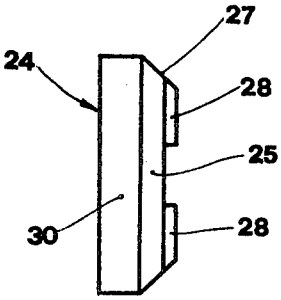
FIG. 16
FIG. 17
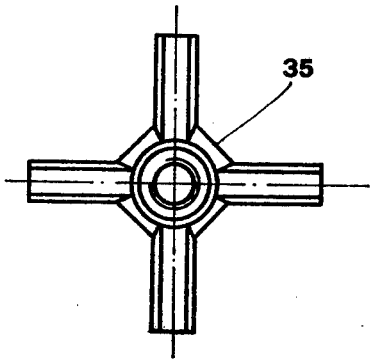
FIG. 18
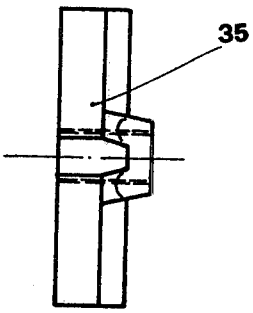

COMPLEX STRUCTURE OBTAINED FROM THE UTILIZATION OF PARTICULAR CLAMPS

This invention relates to a complex structure obtained from the utilization of particular clamps.

As well known, scaffoldings are generally obtained by assembling modular members, differently shaped and jointed to each other by means of suitable connecting organs.

More specifically, the connection of said modular members is normally carried out by the utilization of bolts or clamps, consisting of blocks or plates, with which screws or lever devices cooperate.

Such a connecting operation requires in all cases on each junction knot the execution of one or more interventions, designed, each, to perform the connection of adjacent pairs of members.

Consequently, the execution of any structure whatever to be assembled, even if of the simple type, requires considerable assembly times, which negatively affect the cost of the manufactured products.

The above-outlined inconveniences of a practical and functional nature are instead obviated by the structure according to the present invention, formed by panels and possibly tubular members and/or structural shapes.

Such a structure is actually obtained from the utilization of particular clamps, which ensure an easy assembly of the panels and tubular members or structural shapes according to both coplanar and orthogonal arrangements.

More in detail, the structure of this invention consists of a series of modular members, the connection of which is carried out with the aid of two 2-way clamps and one 4-way clamps, showing an identical operating criterion.

The said clamps consist in practice of pairs of identical bodies, structurally built so as to be mutually engaged, delimiting longitudinal slits.

These longitudinal slits are relative to the 2-way clamps coplanar and respectively orthogonal and relative to the 4-way clamps mutually orthogonal.

The bodies constituting the same clamps define further jointly a cylindrical seat showing chamferred ends with a configuration similar to the frustum of a pyramid with square base.

Into the end portions of the said cylindrical seats there are inserted so many members shaped like frustum of pyramid, substantially structurally built as nuts, spiders, with which a threaded rod engages.

In practice, the rotation of the latter performs a traction between the members shaped like a frustum of pyramid referred to above, which provide a displacement apart of the bodies' components constituting the said cylindrical seat.

Consequently, there occurs a tractive action on the vanes defining the slits, which by narrowing, carry out the clamping of the modular members of general design, inserted inyo the slips themselves.

These and further characteristic features of a functional and constructional nature of the complex structure according to this invention, formed by assembled modular members and clamps adapted to carry out the assembly of the members themselves, will become more apparent from the following detailed description, when taken in conjunction with the figures on the accompanying drawings, in which:

FIG. 13 represents in an elevation view one of the members making up the 4-way clamp;

FIG. 14 shows the said member in plane;

FIG. 15 represents in plane an alternating shape of the same member in case of assembly of flat structures;

FIG. 16 shows the same member in a side view;

FIG. 17 and FIG. 18 illustrate respectively in plane and in a side view one of the spiders, cooperating with the members constituting the 4-way clamp;

Figure 1:
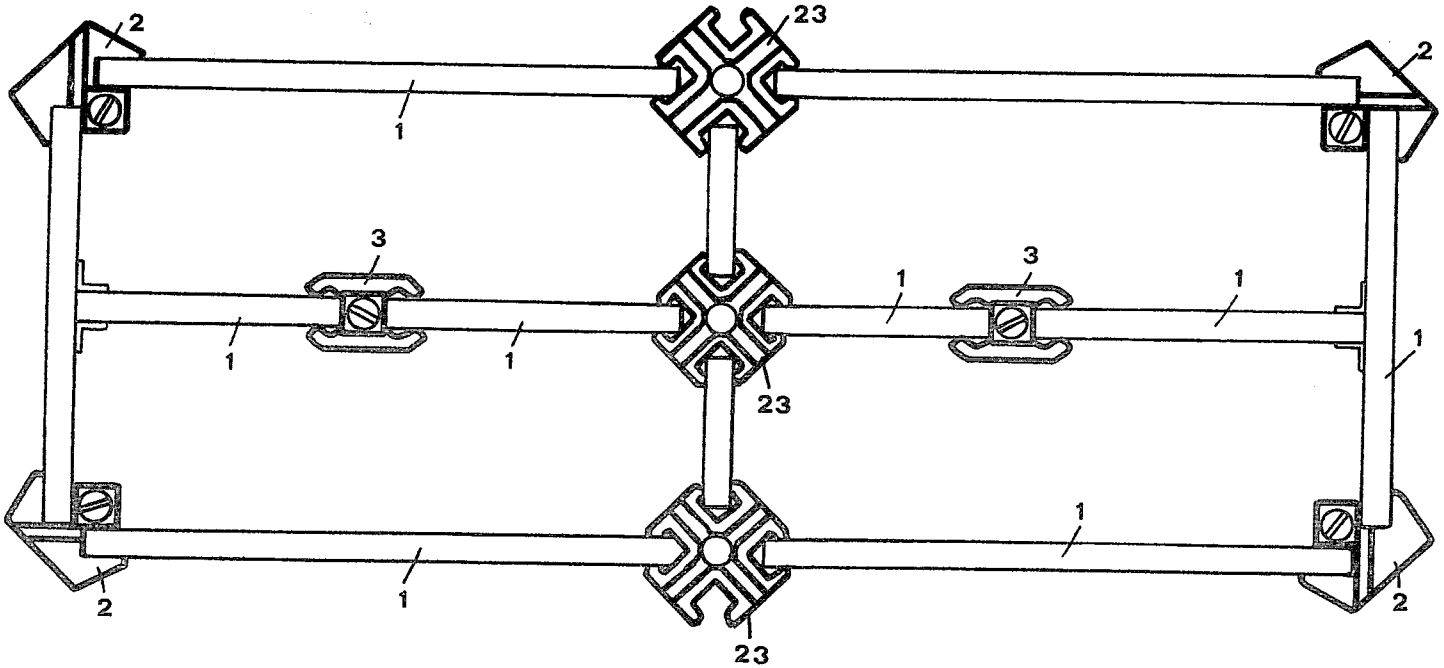
FIG. 1 shows a general embodiment mode of the structure of this invention according to one of the simplest combinations.
Figure 2:
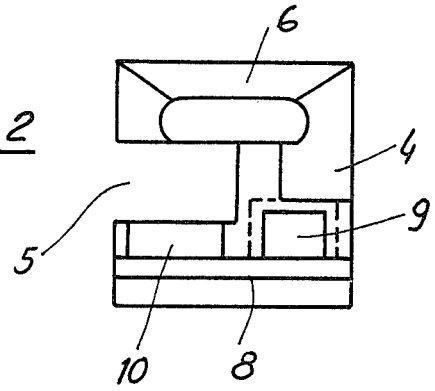
FIG. 2 represents a front view of one of the parts constituting one of the clamps for the assembly of the structure itself.
Figure 3:
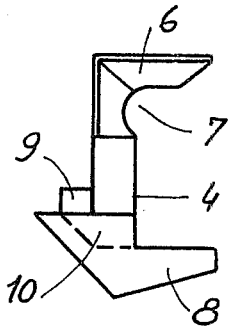
FIG. 3 and FIG. 4 show the same part in side view and in top view, respectively.
Figure 4:
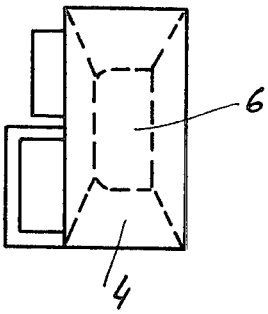
Figure 5:
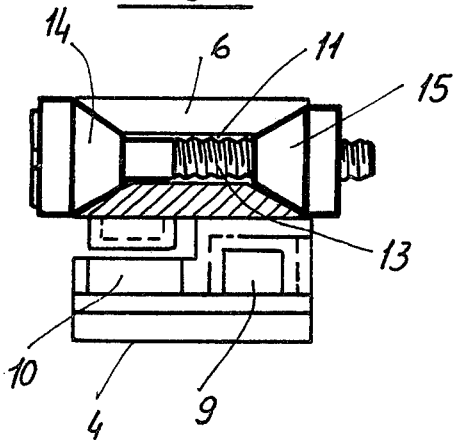
FIG. 5 shows designed a vertical section of the clamp obtained from the coupling of two of the said parts.
Figure 6:
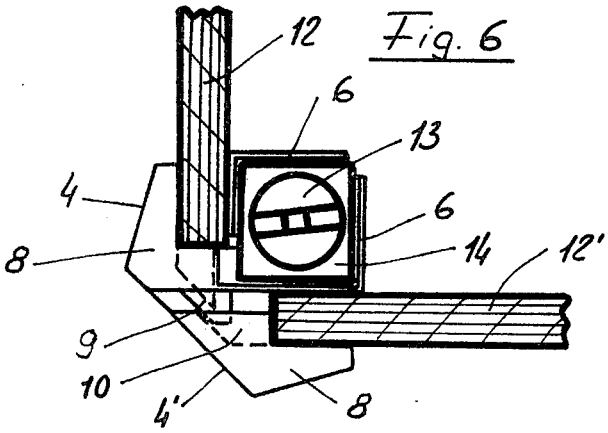
FIG. 6 represents in a side view the same clamp, carrying out the clamping of two mutually orthogonal panels.
Figure 7:
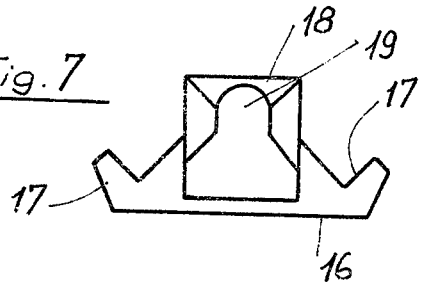
FIG. 7 shows in a front view one of the parts constituting the clamp for the assembly of the coplanar panels.
Figure 8:
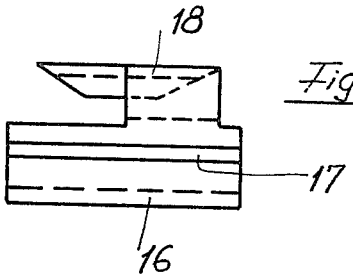
FIG. 8 depicts the same part in a side view.
Figure 9:
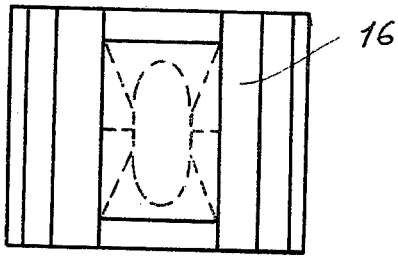
FIG. 9 illustrates in a top view the clamp obtained from the coupling of two of the said parts.
Figure 10:
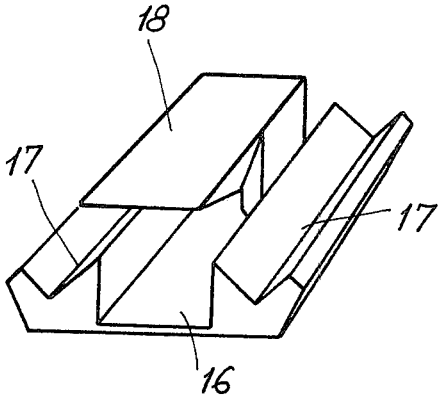
FIG. 10 shows in a perspective view one of the same parts, constituting the aforementioned clamp.
Figure 11:
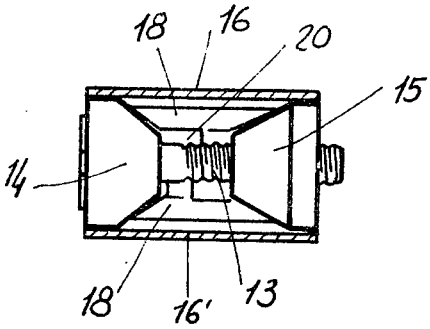
FIG. 11 represents the same clamp in a cross section.
Figure 12:
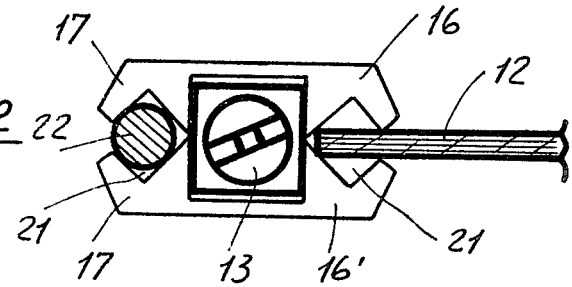
FIG. 12 shows in a front view the same clamp, carrying out the assembly of a panel and a tubular member lying in the same plane.

Referring now particularly to the numeral references given in the different figures on the accompanying drawings, the complex structure of this invention, adapted to particularly serve as scaffolding, consists of a series of flat panels 1 or, more generally, modular members, differently connected to each other, according to coplanar or mutually orthogonal arrangements.

The connecting action between the said panels is accomplished in the case of pairs of orthogonal panels by means of the clamps 2, in the case of pairs of coplanar panels by means of the clamps 3 and in the case of three or four panels being mutually orthogonal by means of the clamps 23.

The clamps 2 consists of the coupling of two complex bodies 4 and 4', showing substantially a U-shaped structure, provided with an intermediary slip 5, adapted to ensure the restraint in opposite positions of the two bodies themselves.

Each of the said bodies shows the upper portion 6 being bent at right angle and chamferred at the edges.

The inner edge 7 of the dihedral formed by the same upper portion is also connected so as to define a half-cylindrical part.

The lower portion 8 of the said bodies 4 and 4' shows, conversely, two parts projecting outwardly 9 and 10, respectively, one of which, designated 9, performs a wedge-shaped structure, whereas the other one, designated 10, builds an open structure and is so dimensioned as to receive the wedge-shaped structure itself. The coupling of the two bodies 4 and 4' arranges in practice so that the portions 6 of these define a seat being substantially of a cylindrical shape 11, whereas the portions 8 build with the outer faces of the bodies themselves two housings, into which so many flat panels 12 and 12'.

Consequently, by placing in said cylindrical seat a threaded traction member 13 between a body with a frustum of pyramid 14 drilled and a nut 15, this, too, shaped like a frustum of pyramid, it is possible to carry out the expansion of the two portions constituting the seat itself.

Such an expansion provokes the retraction of the vanes 8 inwardly and then the clamping of the two panels inserted into the housings defined by the vanes themselves.

The clamps 3 are, conversely, constituted by two equal bodies 16 and 16', showing a median seat and the edges 17 shaped like a dihedral.

The said bodies carry overhanging a structure 18, provided with chamferred longitudinal ends and an internal half-circular groove 19.

The same two bodies are coupled in opposite positions by causing the overhanging structure to slide from the one to the median seat of the other and defining consequently an intermediary cylindrical seat 20 and two side quadrangular seats 21, which may vary in width, by the approach and the mutual removal of the two bodies themselves.

The approach of the pairs of edges 17 with dihedral groove, between which there are placed the panels 12 to be connected to each other in a coplanar fashion, is carried out by placing the threaded traction member referred to atobe with related bodies 14 and 15 shaped like a frustum of pyram in the intermediary seat 20 and provoking by the screwing the mutual removal of the overhanging structures 18, defining the seat itself.

The particular configuration of the edges 17 permits to also carry out the clamping of tubular members 22.

The clamp 23, adapted to effect the connection of three or four members 24, formed substantially by two rectangular plates 25 and 25', parallel and connected by a dihedral structure 26.

Figure 19:
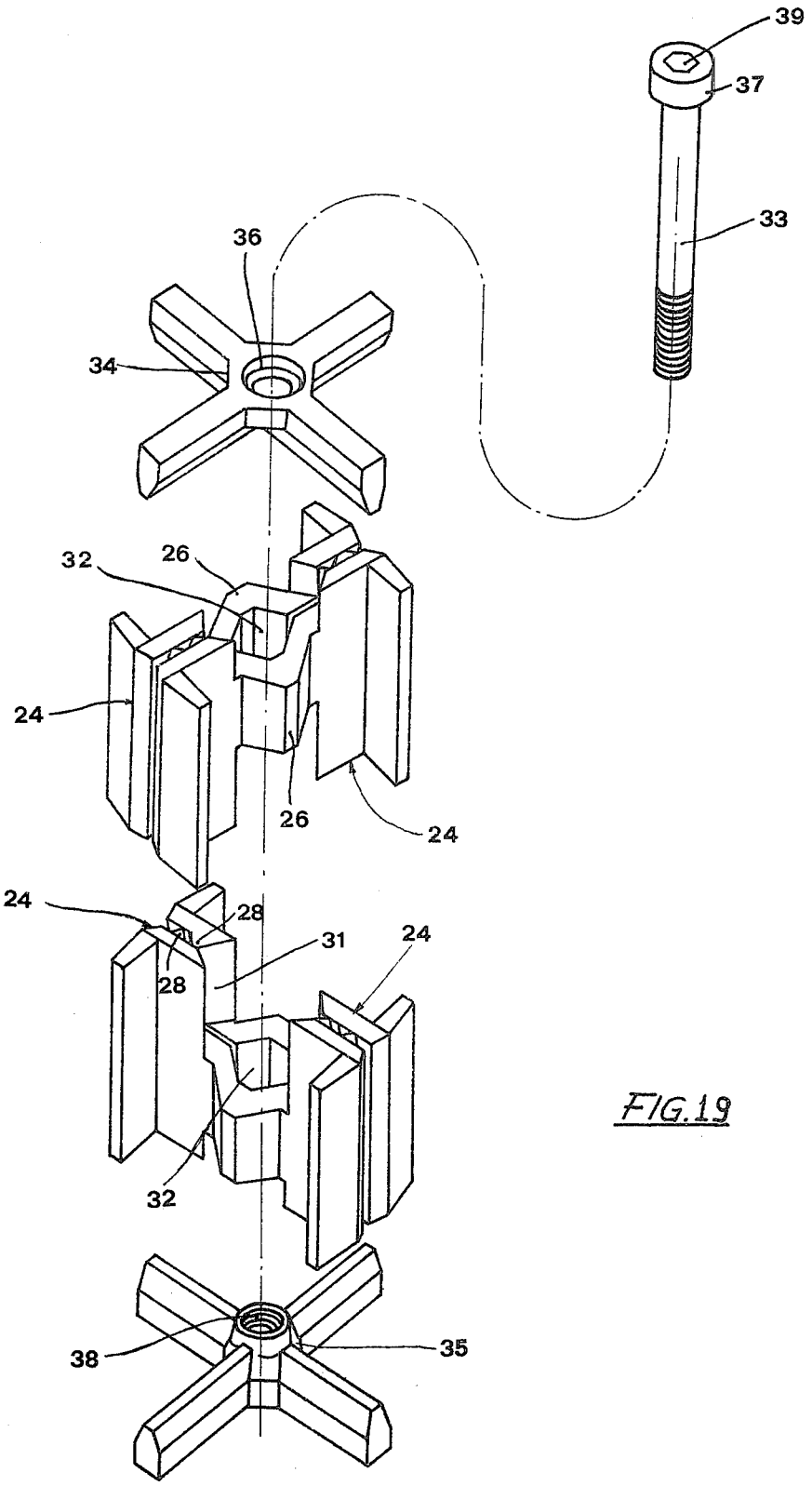
FIG. 19 shows a perspective view (exploded) of the same clamp.
Figure 20:
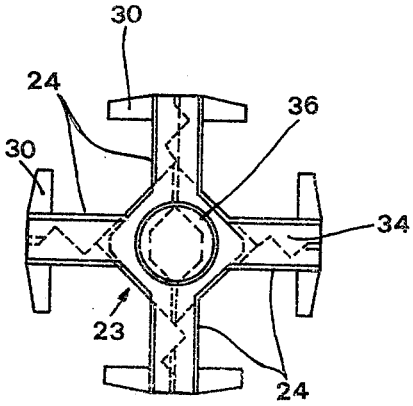
FIG. 20 depicts the same clamp in plane with the component members brought close to each other.
Figure 21:
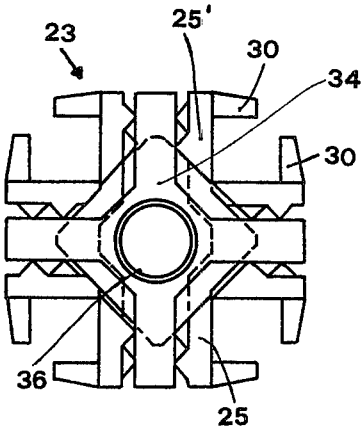
FIG. 21 shows such a 4-way clamp with the component members in decentralized position.
Figure 22:
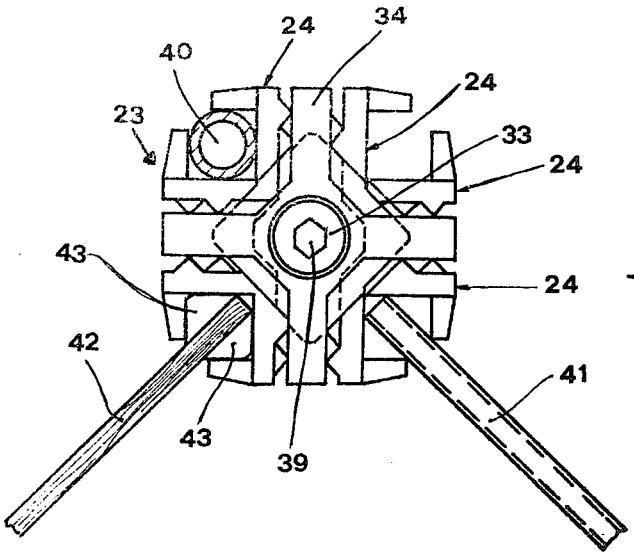
FIG. 22 represents by way of indication the assembly of more structures by means of the said clamp.

The said plates show inclined edges 27 and couple two by two by the reliefs 28 and longitudinal cavities 29, formed in opposite positions (FIG. 19) and adapted to increase the useful thickness of the edges themselves.

The same plates 25 and 25' are provided at the outer edges with a continuous relief 30 of suitable height.

The said edges may show possibly a V-shaped cutting in order to improve the grip on the tubes, disposed in orthogonal sense relative to the edges themselves.

Possibly, the four members 24 may show the structural shape given in FIG. 15, which is particularly adapted for the assembly of so many flat structures.

The said connecting structure 26 is particularly off-center relative to the transversal axis of the aforementioned plates, so that the pairs of members 24 may fit into each other according to a mutually orthogonal arrangement.

It should be specificed in this connection that the angles of the dihedral structures 26 find lodging in the seats, these, too, having a dihedral shape 31, delimited by the inner edges of the pairs of members 24.

The said dihedral structures also delimit a through-hole 32, into which fits a screw 33, which may serve as a connecting organd between two spiders 34 and 35.

The latter show a central frustoconical core or a core having a frustum of pyramid and they are provided with arms having a substantially trapezoidal section.

The said spiders insist on the inclined edges 27 of the two pairs of members 24 and show respectively a cylindrical seat 36 to receive the head 37 of the screw 33 and an inner threading 38. Consequently, by turning the aforesaid screw it is possible to effect the approach and the removal of the two spiders 34 and 35. The said spiders press, therefore, in the approach phase against their arms on the edges 27 of the pairs of members 24, causing the removal and simultaneously performing the approach between the reliefs 30 of the pairs of plates, adjacent and mutually orthogonal of the opposite members.

The screw 33 shows, particularly, preferably, a drilled stem of prismatic section or, at least, a prismatic hole 39, at both ends in order to be easily turned.

The two pairs of members 24 may be further advantageously constrained by one or more elastic means, adapted to carry out the approach of the members of each pair when there is provoked the mutual removal of the spiders 34 and 35.

In practice, by placing the general structures to be connected to each other 40, 41 and 42 between the jaws constituted by the plates 25 and 25' and the related raised edges 30 and acting on the screw 33, so as to obtain the approach of the aforesaid spiders, the clamping of the structures themselves is carried out. In particular, when there are involved flat structure between the plates facing each other and the raised edge thereof there is placed a stabilizing shape 43 of triangular section.

It should also be specified that the configuration of the dihedral structures 26 ensures a possible slide of the spiders in the interstice delimited by the plates 25 and 25' so as to ensure the tightening of shapes or plates of different thicknesses.

What I claim is:

1. A three way or four way clamp adapted to carry out the assembly of at least two panels which comprises four members, each member being formed substantially by two rectangular plates which are parallel and connected by a dihedral structure, the said plates having inclined edges and being coupled in pairs, said plates being provided with a continuous relief, said clamp being intended for use with spiders by means of a screw, wherein the said dihedral structure is off-center relative to the transversal axis of the plates, so that said pairs fit into each other according to a mutually orthogonal arrangement, said dihedral structures delimiting a through-hole, said screw fitting into said through-hole, said screw connecting said spiders, wherein the said spiders show a central core of frustoconical shape and are provided with arms having a substantially trapezoidal section, said spiders pressing on the inclined edges of the two pairs of said plates and forming a cylindrical seat to receive the head of the said screw and an inner threading.

2. The clamp according to claim 1 wherein said plates are coupled in pairs by means of relief portions which engage with longitudinal cavities formed in opposite positions.

3. A clamp as defined in claim 1, wherein said screw has a drilled stem of prismatic section or a prismatic hole at both ends.

4. A clamp as defined in claim 1, wherein said two pairs are engaged by at least one elastic means.

* * * * *